US006526722B1

(12) United States Patent
Pangburn

(10) Patent No.: US 6,526,722 B1
(45) Date of Patent: Mar. 4, 2003

(54) WOOD FENCE POST REPAIR DEVICE

(76) Inventor: Daniel Wesley Pangburn, 501 Via Codo, Fullerton, CA (US) 92835-1453

( * ) Notice: Subject to any disclaimer, the term of this patent is extended or adjusted under 35 U.S.C. 154(b) by 0 days.

(21) Appl. No.: 09/940,213

(22) Filed: Aug. 28, 2001

(51) Int. Cl.[7] ..... E04H 17/22

(52) U.S. Cl. ..... 52/698; 52/146; 52/169.13; 52/170; 256/35; 256/64

(58) Field of Search ..... 52/146, 153, 154, 52/155, 169.13, 170, 698, 127.2; 256/30, 31, 35, 36, 63, 64, 65.14; 248/679

(56) References Cited

U.S. PATENT DOCUMENTS

| | | | | | |
|---|---|---|---|---|---|
| 73,090 | A | * | 1/1868 | Gormley | 256/64 |
| 349,266 | A | * | 9/1886 | Ayres | 52/153 |
| 382,992 | A | | 5/1888 | Lindley | |
| 403,977 | A | * | 5/1889 | Wickers et al. | 256/35 |
| 580,311 | A | * | 4/1897 | Hammett | 256/35 |
| 784,137 | A | * | 3/1905 | Book | 52/146 |
| 887,217 | A | | 5/1908 | Oliphant | |
| 1,679,297 | A | | 7/1928 | Ehrler | |
| 3,230,626 | A | * | 1/1966 | Berrien | 256/65.14 |
| 4,296,584 | A | | 10/1981 | Lampa | |
| 4,329,826 | A | | 5/1982 | Flogaus | |
| 4,378,657 | A | * | 4/1983 | Romberg | 49/272 |
| 4,516,365 | A | | 5/1985 | Chapman | |
| 4,543,757 | A | | 10/1985 | Cosgrove | |
| 4,598,512 | A | | 7/1986 | Chapman | |
| 4,646,489 | A | | 3/1987 | Feller | |
| 4,979,725 | A | * | 12/1990 | Hutchings et al. | 182/82 |
| 5,577,713 | A | | 11/1996 | Navarez | |
| 5,636,482 | A | | 6/1997 | Klager | |
| 6,230,449 | B1 | * | 5/2001 | Colvin, Jr. | 52/164 |
| 6,336,623 | B1 | * | 9/2002 | McCarthy | 182/113 |

FOREIGN PATENT DOCUMENTS

| | | | | |
|---|---|---|---|---|
| GB | 1037057 | * | 7/1966 | 52/146 |
| GB | 2259923 | * | 3/1993 | 256/65.14 |
| SU | 661071 | * | 5/1979 | 52/170 |

* cited by examiner

*Primary Examiner*—Carl D. Friedman
*Assistant Examiner*—Brian E. Glessner

(57) ABSTRACT

A device to inexpensively repair a wooden post that has rotted or failed. The device comprises a plate which has a plurality of holes drilled or punched in it for attaching above ground level to a side of a wooden post and at least two rods depending out and down from the face of the plate. At least one of the rods depends near the top of the plate and at least one of the rods depends near the bottom of the plate. This location of the rods allows them to work cooperatively in tension-compression to counteract a moment tending to overturn the post. The rods extend into a hole dug in the soil adjacent to the existing post footing. After the fence has been aligned as desired, the hole is filled with concrete surrounding the rods.

4 Claims, 1 Drawing Sheet

WOOD FENCE POST REPAIR DEVICE

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

1. Field of Invention

This invention relates to articles of manufacture.

2. Description of the Prior Art

Wood posts are set is the ground to support wood fence. The posts can be set directly in the ground, or, the part of the post that is below ground may be embedded in concrete. The part of the post that is below ground level, whether embedded in concrete or not, often rots resulting in the supported wood fence falling over requiring that the post be replaced or repaired. Previous devices to repair wooden posts have been difficult to install, unsightly, expensive or inherently weak. Therefore a need exists for a device to easily, inexpensively and durably repair an existing deteriorated wooden post such that its structural function is restored. Prior art consists of:

U.S. Pat. No. 887,217, Oliphant, is suitable only where the new footing is directly below the post. Also, although two straps are shown attached to each of two plates, the straps are attached to each plate at the same level. The concept of an upper and lower rod attached to a single plate where the rods work in tension-compression to develop moment was clearly not known.

U.S. Pat. No. 1,679,297, Ehrler, shows a plurality of rods but is for new construction or repair where the new footing is directly below the post. Also, the rods are each attached directly to the post instead of to a common plate. The concept of an upper and lower rod attached to a single plate where the rods work in tension-compression to develop moment was clearly not known.

U.S. Pat. No. 382,992, Lindley, for a fence post bracing and anchoring means. This invention incorporates inclined compression braces and tension rods attached to a buried anchor to react forces imposed by tension in a wire fence. The diagonal rods in this patent are horizontally disposed and, in themselves, provide negligible bending strength. The construction is unsuitable for repair of a wooden fence because it will resist force in only one direction.

U.S. Pat. No. 4,296,584, Lampa, for a bracket with a horizontal leg. The bracket must be thick, or have gussets or a torque box, any of which increase cost, to provide adequate strength and stiffness to resist lateral forces on the fence produced by high wind. Also, the horizontal leg covers much of the new hole that needs to be dug. This leg limits access and interferes with pouring the concrete.

U.S. Pat. No. 4,329,826, Flogaus et al., for a plate with the edge profiled and set in concrete. A plate configuration is not compatible for incorporation into the small diameter of a concrete post footing because the plate causes a weakened plane in the concrete substantially reducing its strength.

U.S. Pat. No. 4,543,757, Cosgrove, for 2 apposing angles that essentially surround the bottom of the post. This configuration impedes ventilation of the area at the bottom end of the post so deterioration of the bottom of the wooden post may still proceed at an excessive rate. Also, the concrete strength issue when a plate is used, as discussed in the previous paragraph, exists here.

U.S. Pat. No. 4,516,365, Chapman, for a device to re-anchor a post. The device incorporates features to wedge it tightly in place when it is driven into an existing aperture. This structure is large and since it requires access to most or all of the circumference of the post, is difficult to use in repairing a fence post which has boards on the back and stringers on the sides. Also, because of its configuration and large size, it would substantially degrade the aesthetic appearance of the wooden fence.

U.S. Pat. No. 4,598,512, Chapman, for a single device to re-anchor a post. This device has a plurality of corrugations and is designed to be driven into the aperture and clamped or screwed to the post. This structure is also large and since it also requires access to most or all of the circumference of the post, is not suitable to use in repairing a fence post which has boards on the back and stringers on the sides. Also, because of its configuration and large size, it would substantially degrade the aesthetic appearance of the wooden fence.

U.S. Pat. No. 4,646,489, Feller et al., for a hollow square plastic extension for a post. The claim is for triangular notches at the bottom of the plastic to allow concrete that has been poured into the hollow plastic extension to flow out at the bottom to firmly anchor it and the post. To use the aforementioned invention to repair an existing fence post, the existing concrete footing would need to be removed, a difficult task.

U.S. Pat. No. 5,636,482, Klager, for a repair anchor that is driven into the existing hole made by the rotted out post bottom in the concrete footing. This invention requires that the fence be temporarily moved laterally at the post to be repaired to provide access to the hole in the footing and that the post be trimmed on the side to accommodate the anchor. The necessity to trim the post makes this device difficult to install. Also, this device is of reduced suitability in cases where the existing concrete footing is unsound.

U.S. Pat. No. 5,577,713, Navarez, for a method using an anchor device incorporating a single stake (or rod or tube). The use of a single rod requires over four times as much rod material for the same strength as two properly positioned rods to resist the same overturning moment, resulting, for example, from wind on a fence. Thus, for the same strength, this device is more costly to manufacture.

BRIEF SUMMARY OF THE INVENTION

To avoid the limitations and problems with present devices, this invention relates to an improved device which is used to repair a fence post.

The device incorporates a vertical mounting plate with at least one rod depending out and down from the plate near the top of the plate and at least one rod depending out and down from the plate near the bottom of the plate. By using optimum positioning of two rods attached to a single mounting plate, less than ¼ of the amount of material is required for rods compared to a device with a single rod for the same performance. The reason for this is that two rods, properly positioned, work in 'tension-compression' to resist an overturning moment of, for example, the wind on the supported fence, while a single rod can only work in bending. By proper positioning of a plurality of rods depending out and down from a common mounting plate, the rods work synergistically. The strength of the combination is much greater than the sum of the strengths of the individual rods. Thus the use of a plurality of rods depending out and down from a single mounting plate provides a substantial improvement over a single rod.

OBJECTS OF THE INVENTION

Objects of the present invention are to provide a device that a) can be bolted or screwed to an existing post that has deteriorated below ground level, b) can be anchored by means of a new concrete footing, c) has a plurality of rods that depend at an angle out and down from the face of the plate so that they can work cooperatively in 'tension-compression' for efficient strength, d) can be very resistant to deterioration, e) can be easily and conveniently installed, f) uses a minimum of material and is inexpensive to manufacture, g) does not limit access to the hole in the ground to receive the concrete mixture or interfere with the placement of the concrete mixture, and h) does not substantially degrade the aesthetics of a wooden fence.

These and other objects of the invention are provided by a novel device. The invention is a device which includes a vertical plate with holes so that the plate can be bolted or screwed near the bottom end of a wooden post, and a plurality of rods that depend out and down from the face of the plate, said rods extend into a hole dug adjacent to the existing concrete footing. Wet concrete is poured into the hole around the rods. The concrete cures to anchor the device in place.

At installation, a hole of sufficient depth and diameter is dug in the soil adjacent to the existing post footing. The device is attached to the post near the ground by either bolts or lag screws, while the rods extend down into the newly dug hole. The post is aligned to the desired height and verticality and supported with appropriate temporary bracing. Concrete is then poured into the hole, surrounding the rods, until the hole is filled to approximately ground level.

After the concrete has set, the post will be supported firmly in place and the temporary bracing can be removed. The post can be cut away from ground level to a few inches above ground level to provide ventilation and impede further deterioration of the post.

DETAILED DESCRIPTION OF THE INVENTION

Figure 1:
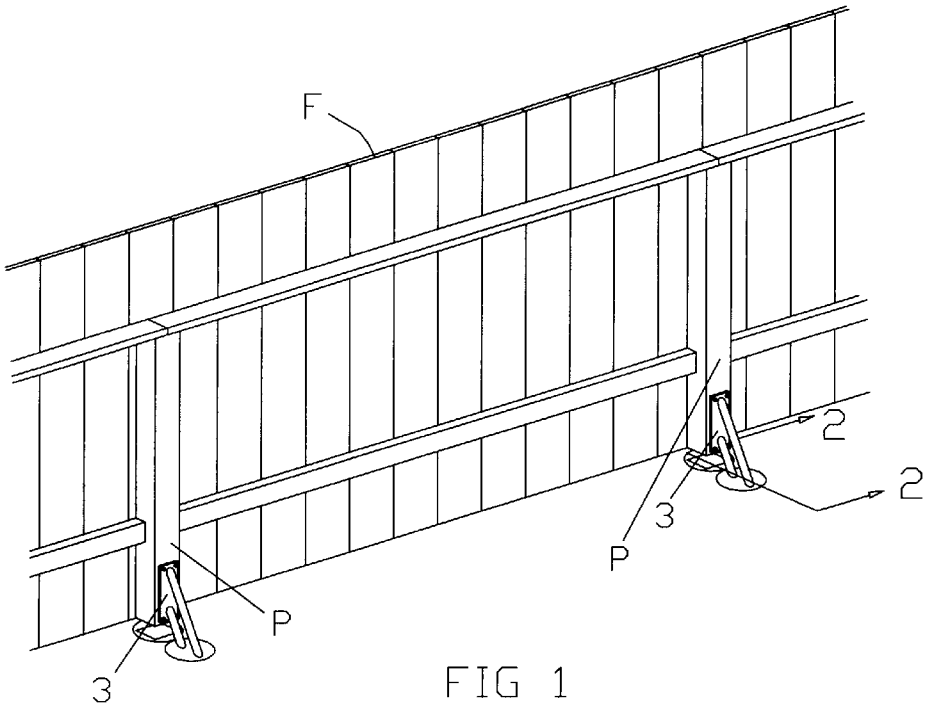
FIG. 1 is a perspective view of the preferred embodiment of the present invention shown supporting a wood fence.
Figure 2:
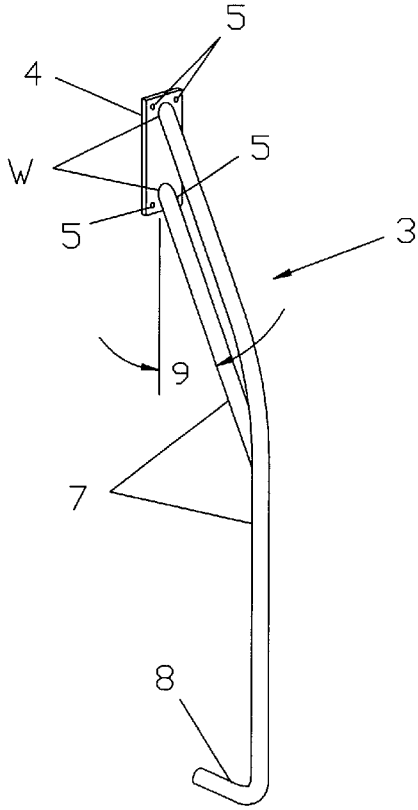
FIG. 2 is a perspective view of the device itself.

With reference to FIG. 1, a device for repairing a fence post P or any such related post which has rotted at its base, is shown generally as 3. It is shown supporting fence F. Referring to FIG. 2, the device is shown in greater detail. The device 3 comprises a vertical plate 4, said plate having a sufficient number of holes 5 of adequate diameter to accommodate bolts or screws 6 to attach the device to a post P. In addition, the device 3 has a plurality of rods 7 such as concrete reinforcing bars with or without hooked ends 8. The rods 7 are coupled to the plate 4 near the top and bottom of the plate by means of welds W. The rods 7 depend out and down from the face of the plate 4 at an angle 9 so that the rods 7 can work cooperatively in tension-compression to counteract the bending moment imposed by the fence F during high wind or other loading conditions.

Figure 3:
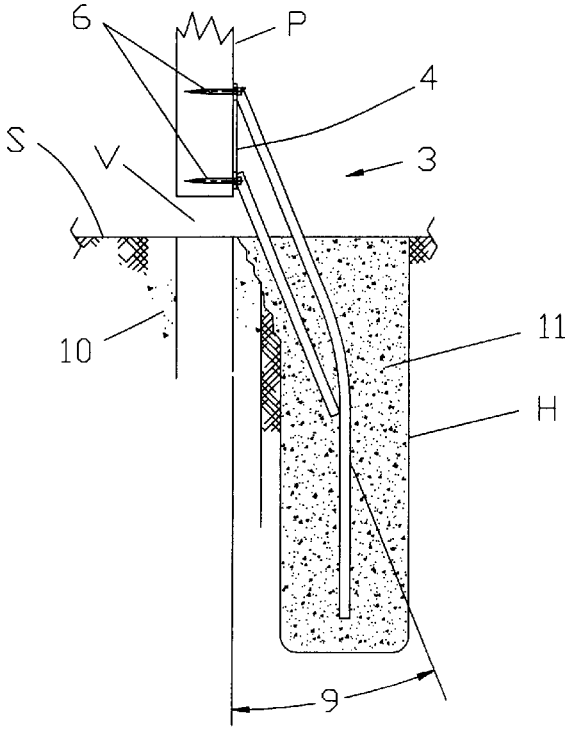
FIG. 3 is a sectional view of the present invention as installed, taken along line 2—2 of FIG. 1.

FIG. 3 shows the installed device. A hole H of sufficient depth and diameter is dug in the soil S immediately adjacent to the old concrete footing 10. The device 3 is attached to the post P by means of attachment bolts or screws 6 in a position such that the rods 7 of the device 3 extend down into the newly dug hole H. The fence F is aligned to its desired position and attitude and held in place with temporary bracing. A concrete mixture 11 is then poured into the hole H until it is filled to a level approximately even with ground level. After the concrete is set, the temporary bracing is removed and the post may be cut away from ground level to above ground level providing a ventilation space V between the bottom of the wood post P and ground level to impede further deterioration of the post.

Although the invention is described with respect to preferred embodiments, modifications thereto will be apparent to those skilled in the art. Therefore, the scope of the invention is to be determined by reference to the claims which follow.

I claim:

1. A device to re-anchor in the ground a wooden post of a fence, wherein the post has at least one face generally parallel to the run of the fence, without requiring that the post's existing footing be disturbed, said device comprising:

a) a generally vertical, substantially flat plate from which depends, from one face of the plate, a plurality of rod members, b) said vertical plate to be from about three to about ten inches long in the vertical direction, c) said vertical plate to be positioned completely above ground level, d) said vertical plate to be oriented for attachment to the post on the face of the post that is substantially parallel to the run of the fence, e) a plurality of holes in the plate for fasteners to attach the plate to the wooden post, f) said rod members fixedly attached to the plate, g) at least one of the rod members depending from the plate near the top of the plate, h) at least one of the rod members depending from the plate near the bottom of the plate, i) said rod members depending at an acute angle out and down from the plate so the rod members can work cooperatively with at least one rod member substantially in tension and at least one rod member substantially in compression to resist overturning moment on the post, j) all rod members to be substantially straight above ground level, k) that part of the length of any rod member that is to be above ground level is less than 100 times the radius of gyration of its cross sectional area, l) at least one of the rod members is curved down below ground level to align approximately with the centerline of a new hole dug in the soil adjacent to the existing post footing and, m) the rod members are to be anchored in place in the new hole in the ground by filling the hole with uncured concrete which then cures.

2. A device to re-anchor a wooden post as set forth in claim 1 in which the rod members are attached to the plate by welding.

3. A device to re-anchor a wooden post as set forth in claim 1 in which the rod members are concrete reinforcing bar.

4. A device to re-anchor a wooden post as set forth in claim 1 in which the device is made from reinforced plastic material.

* * * * *